US006918580B2

(12) United States Patent
Obregon et al.

(10) Patent No.: US 6,918,580 B2
(45) Date of Patent: Jul. 19, 2005

(54) STAPLE ESTIMATION DEVICE AND METHOD

(75) Inventors: Roberto Obregon, Jalisco (MX); Paul K. Mui, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 6 days.

(21) Appl. No.: 10/420,234

(22) Filed: Apr. 22, 2003

(65) Prior Publication Data

US 2004/0212135 A1 Oct. 28, 2004

(51) Int. Cl.[7] ..... B65H 37/04
(52) U.S. Cl. ..... 270/58.09; 227/2
(58) Field of Search ..... 270/58.08, 58.09; 227/2, 3, 5

(56) References Cited

U.S. PATENT DOCUMENTS 3,685,712 A * 8/1972 Turner et al. ..... 227/3
4,386,725 A * 6/1983 Chambers ..... 227/2
4,516,713 A * 5/1985 Meijer ..... 227/2
4,523,750 A * 6/1985 Hubler ..... 270/58.08
4,703,881 A * 11/1987 Riddell ..... 227/1
4,978,045 A * 12/1990 Murakami et al. ..... 227/1
5,106,066 A * 4/1992 Shea et al. ..... 270/37
5,114,130 A * 5/1992 Hamanaka et al. ..... 270/58.11
5,269,503 A * 12/1993 Hiroi et al. ..... 270/58.09
5,441,191 A * 8/1995 Linden ..... 227/120
5,938,100 A 8/1999 Bloser et al.
6,089,498 A * 7/2000 Sticht ..... 242/563
6,474,633 B1 * 11/2002 Hirai ..... 270/58.09

* cited by examiner

*Primary Examiner*—Patrick Mackey

(57) ABSTRACT

A document handling machine comprises a stapling device, and a staple cartridge operatively connected to the stapling device and including a staple estimating device adapted for measuring rotational movement of a roll of staples held within the staple cartridge and for estimating a quantity of the staples based on the measured rotational movement.

19 Claims, 4 Drawing Sheets

Fig. 7 INFORMATION FLOW FOR THE CALCULATION OF STAPLE LEVEL IN A STAPLE CARTRIDGE
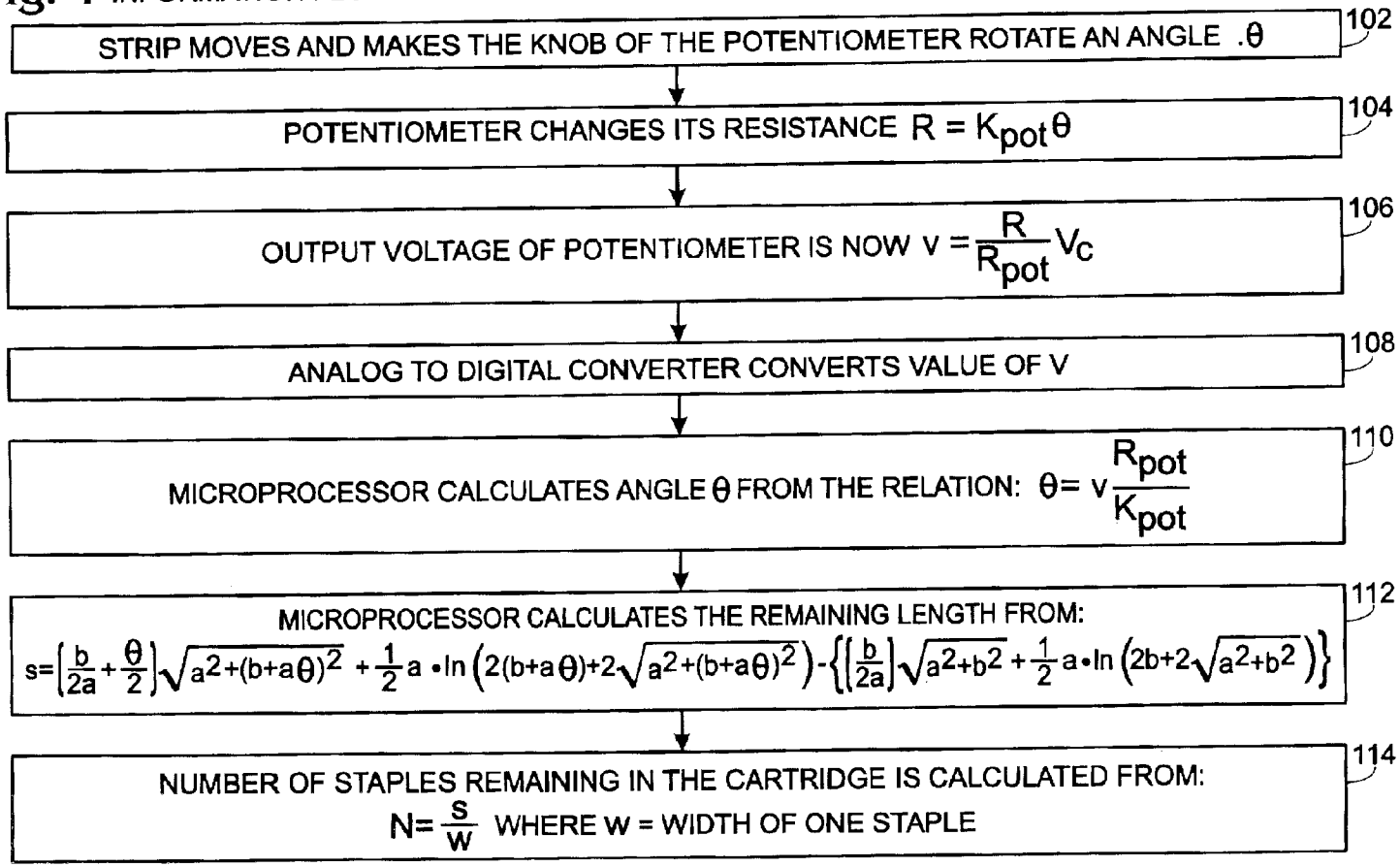

STAPLE ESTIMATION DEVICE AND METHOD

BACKGROUND

Printers, copiers and other such document handling equipment may use electric staplers as one of their components. These machines may be left unattended during copying, printing or otherwise handling a large number of documents, e.g., a large print job, wherein each of the documents produced may be held together with a staple. Prior to initiating a large print job the print operator may inspect the printer to ensure the printer contains the required number of consumables, such as toner, paper and staples, for example. The amount of paper and toner held in the printer may be estimated visually by the print operator. Paper and toner generally are typically held in the printer in a vertically orientated container so that the amount of paper and toner may be measured by the printer automatically by measuring the height of the consumable. In a printer that measures automatically the amount of paper and toner remaining, a warning may be displayed electronically on a display pad of the printer when these consumables are low. The amount of paper and toner remaining in the printer, therefore, can be ascertained without opening or otherwise visually inspecting the paper or toner storage areas.

Staples generally are provided in a roll such that a simple level, i.e., height, indicator is not sufficient to calculate, or estimate, the number of staples remaining in a cartridge. Accordingly, heretofore, determination of the number of staples remaining in a staple cartridge has been ascertained, or estimated, by manual, visual inspection of the staple cartridge. Some staple cartridges have been manufactured of transparent material so that the contents of the staple cartridge can be inspected without opening or removal of the cartridge from the printer or copier. While such a visual inspection method may be adequate for some users, visual inspection is generally not ideal in a high volume production environment, such as in a printing shop where a single operator may be operating multiple printers. Moreover, such a visual inspection method may not be convenient in a system where the printer is operated from a control device located at a remote site, such as from a computer located in another office or building. For example, an operator may order a print job at his or her computer, wherein the computer is located in a different area of the building from the printer. In such a case, visual inspection of the number of staples remaining in the printer would require the operator to leave his or her office, travel to the printer, visually inspect the number of staples remaining, and then return to his or her office to begin the print job. Moreover, visual inspection generally provides only a rough approximation of the number of staples remaining in a staple cartridge such that even after visual inspection, a print job may be halted due to lack of a sufficient number of staples to complete the print job.

Thus, for these and other reasons there is a need for the present invention.

SUMMARY

A document handling machine comprises a stapling device, and a staple cartridge operatively connected to the stapling device and including a staple estimating device adapted for measuring rotational movement of a roll of staples held within the staple cartridge and for estimating a quantity of the staples based on the measured rotational movement.

BRIEF DESCRIPTION OF THE DRAWINGS

FIG. 7 is a flow diagram of the method of staple calculation in accordance with an example embodiment.

DETAILED DESCRIPTION

Figure 1:
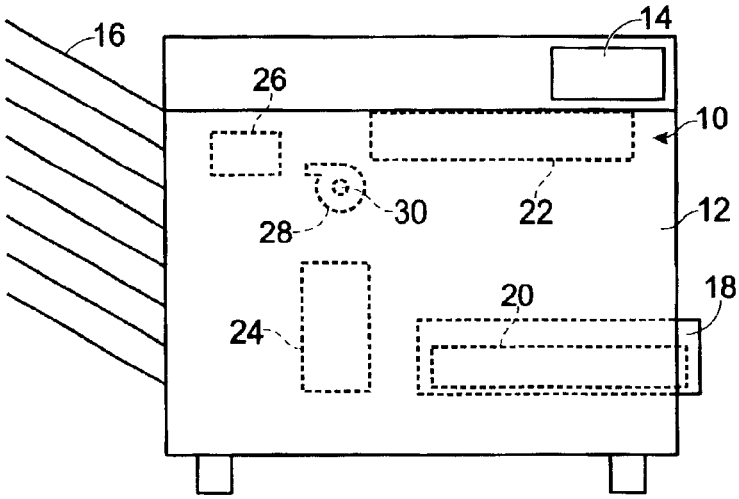
FIG. 1 is a front view of a document handling machine including one embodiment of the staple counting device of the present invention, wherein the counting device is shown in dash lines.

FIG. 1 is a front view of a document handling machine including one embodiment of the staple counting device of the present invention, wherein the counting device is shown in dash lines. Document handling machine 10 may comprise a printer, a copier or any other such document handling machine that may utilize a stapling device. For ease of illustration, machine 10 will be described using the example of a high-volume copier. Copier 10 comprises a housing 12 that encloses internal components therein and includes external components such as display and/or input pad 14, and document output collation trays 16. The internal components of copier 10 may include a print media tray or drawer 18 for holding a stack of print media 20, a copying device 22, a toner cartridge 24, a stapling device 26, also referred to as a stapler, and a staple cartridge 28. Staple cartridge 28 includes therein a staple counting device 30, as will be described in more detail below. During use, a sheet of print media 20 may be fed from tray 18 to copying device 22, wherein toner cartridge 24 is connected to copying device 22. After an image is copied on print media 20, the sheet may be fed to collation tray 16. After the copy job is completed, each of completed documents held on collation trays 16 may be stapled together by stapler 26 utilizing staples from staple cartridge 28. In another embodiment, stapling commences before completion of the copy job. Details regarding one embodiment of a stapler are disclosed in U.S. Pat. No. 5,818,186, the disclosure of which is hereby incorporated by reference.

Figure 2:
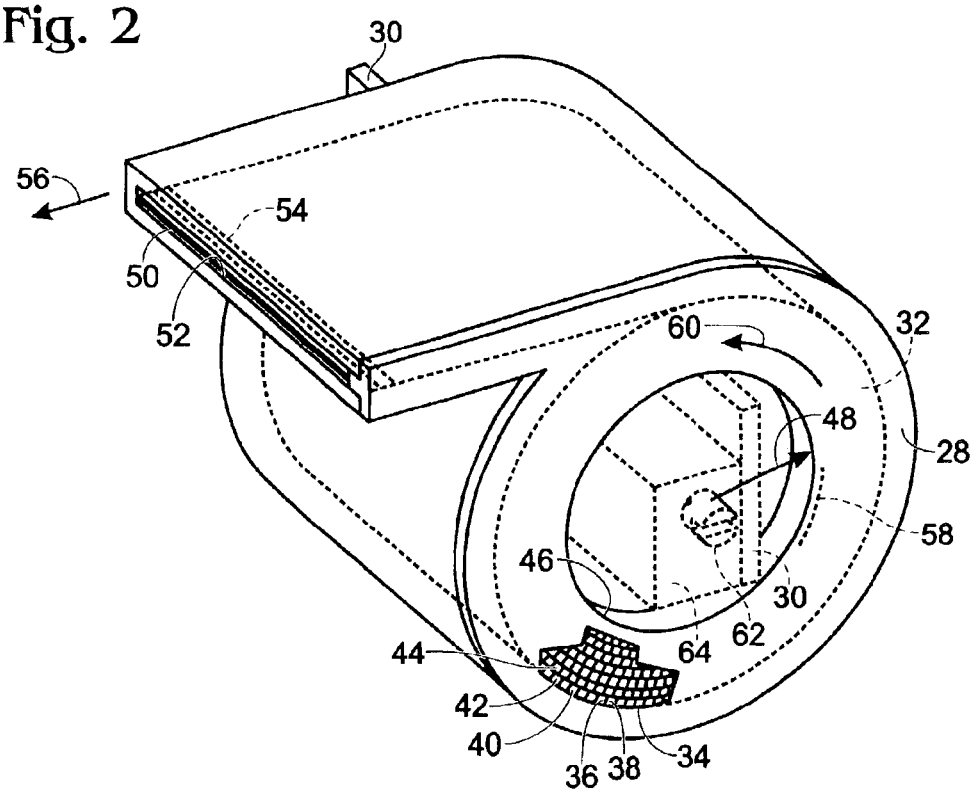
FIG. 2 is a perspective view showing one embodiment of the staple counting device of FIG. 1 wherein a staple strip and a measurement device located within the staple counting device are shown in dash lines.

FIG. 2 is a perspective, partially cut-away view showing the staple counting device 30 of FIG. 1 wherein a staple strip and a measurement device located within the staple counting device are shown in dash lines. Staple cartridge 28 includes staple counting device 30, shown in dash lines, and a strip of staples 32, also shown in dash lines. Strip 32 may comprise a long strip 32 of wires packed inside cartridge 28. The strip 32 may include individual staples 34, in an unbent, flat configuration, fastened together side by side such that the rear surface 36 of a staple is secured to the front surface 38 of the following staple. The individual staples 34 may be held together in strip 32 by any securement material, such as by adhesive or the like. The strip 32 is tightly wound so it takes the shape of a spiral 40, with individual loops, 42 and 44, for example, of the spiral 40 positioned directly on top of the previous loop. Accordingly, outer loop 42 is positioned directly on previous loop 44. In the embodiment shown there is no wire material positioned centrally within the inner edge 46 of the spiral 40 so as to maintain a minimum radius of curvature 48 in order to prevent strip 32 from breaking. Each time that stapler 26 is operated, an endmost staple 50, shown at opening 52 of cartridge 28, is separated from the remainder of strip 32 and is formed into a "U" shaped wire. The "U" shaped wire is then forced by stapler 26 to penetrate through a document, and the ends then bent toward the document, to hold the document together as known in the art.

After endmost staple 50 is removed from strip 32, the next staple 54 in strip 32 becomes the endmost staple of the strip. Endmost staple 54, and the remainder of strip 32, is then moved forward so that endmost staple 54 is positioned at opening 52 of cartridge 28. Movement of strip 32 in forward direction 56 is accomplished by any known means. In one example, strip 32 is moved in direction 56 by pulling the end 54 of strip 32. The force on strip 32 may comprise a magnetic force, a mechanical force or any other such force as may be sufficient to move the new endmost staple 54 into position at cartridge opening 52.

Movement of endmost staple 54 of strip 32 will result in rotation of the centermost loop 58, positioned at radius of curvature 48, in a rotational direction 60. Rotation of centermost loop 58 may be very small and slow, so that the rotation of strip 32 can be used to turn an adjusting knob 62 of a staple counting device 30, such as a potentiometer 64.

Figure 3:
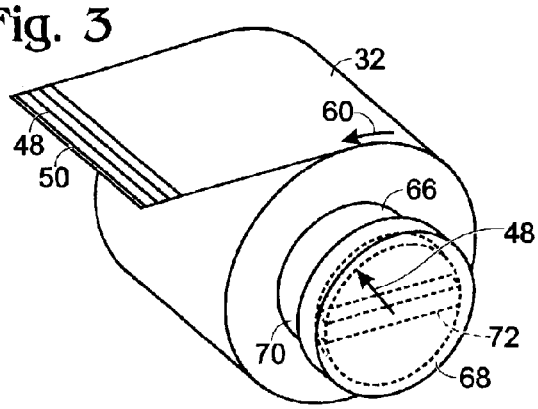
FIG. 3 is a perspective view of the strip of staples of FIG. 2.

FIG. 3 is a perspective view of strip of staples 32. Strip 32 may be positioned on a cylindrical core 66 wherein an outer diameter of core 66 defines radius of curvature 48 of strip 32. A cap 68, also referred to as a coupling member, may be placed on an end 70 of core 66 wherein cap 68 may include a cross bar 72 extending across a diameter of the cap 68. Cross bar 72 may be sized to be received within a slot 74 (shown in FIG. 4) of potentiometer adjusting knob 62. Strip 32 may be secured on core 66 such that movement of strip 32 in rotational direction 60 will result in simultaneous movement of core 66, and cap 68 secured thereto, in rotational direction 60. Movement of cap 68 in rotational direction 60 will result in movement of crossbar 72 in rotational direction 60, such that the cross bar 72 will simultaneously move potentiometer knob 62 (FIG. 4) in rotational direction 60. However, potentiometer 64 may be secured within housing 12 of copier 10 such that as potentiometer knob 62 is rotated in direction 60, the remainder of potentiometer 64 will remain stationary within core 66.

Figure 4:
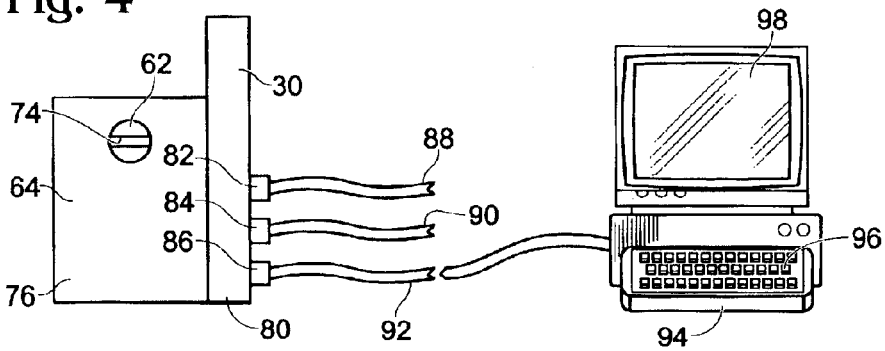
FIG. 4 is a side view of the measurement device of the staple counting device of FIG. 1.

FIG. 4 is a side view of staple counting device 30. Staple counting device 30 includes staple measurement device 64, such as a compact, multi-turn potentiometer 64. In the embodiment shown, potentiometer 64 comprises a potentiometer manufactured by Bourns, brandname Trimpot, and having part number 3006PDM3102W, though any suitable potentiometer may be used. Potentiometer 64 may include a housing 76 and knob 62 extending outwardly therefrom. Knob 62 may include a slot 74 adapted to receive therein cross bar 72 (see FIG. 3) of cap 68 (see FIG. 3). A printed circuit board 80 may be secured to potentiometer 64. Printed circuit board 80 may include three electric terminals 82, 84 and 86, connected to corresponding wires 88, 90, and 92, respectively. Wires 88 and 90 may be used to provide a constant voltage to the ends of the potentiometer 64. For example, wire 88 may provide a constant, positive voltage source and wire 90 may comprise a ground wire. Wire 92 may be used for transmitting a signal from the potentiometer 64, or from an associated microprocessor (not shown), to an operator input and/or output device 94 positioned adjacent copier 10 or at a remote location. Device 94 may comprise a microprocessor and may include an input pad 96 for the input of instructions to copier 10 and a display screen 98 that may show the status of a print job and the quantity of consumables available within the copier, such as the amount of paper, toner and staples remaining in copier 10.

Figure 5:
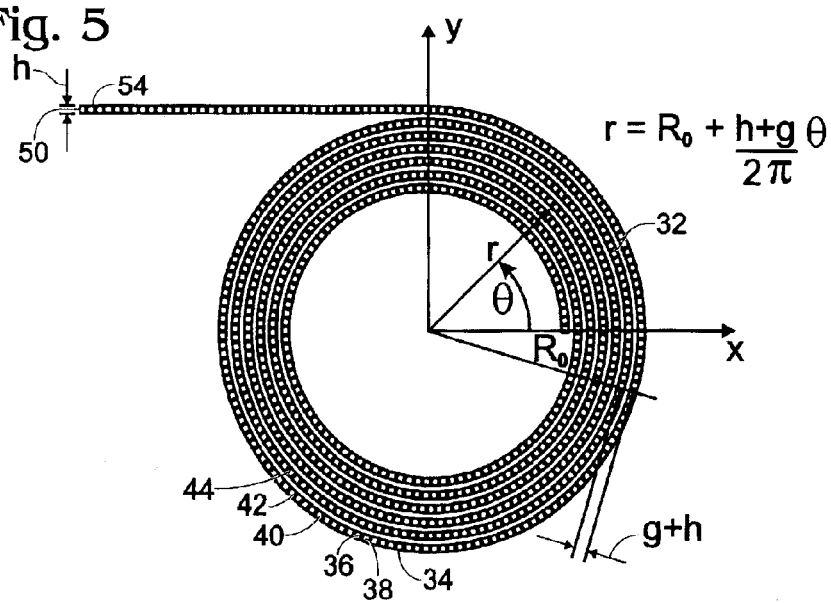
FIG. 5 is a side cross-sectional view of the staple strip in an initial position according to an example embodiment.

FIG. 5 is a side view of the staple strip in an initially loaded position. In this view, staple strip 32 is new, or at a maximum length. As staples are dispensed from the strip 32, the knob 62 rotates and varies the output of the potentiometer according to the angle through which the strip has rotated. If the potentiometer is linear, the voltage reading of the potentiometer 64 is an indicator of the angle that the core shaft 66 has rotated through. Accordingly, this angle of rotation may be associated with the amount of staples that have been removed from staple cartridge 28 to estimate the number of staples remaining in cartridge 28.

A close approximation to the staple strip 32 is an Archimedes' spiral. The last portion of strip 32, i.e., the straight section of strip 32 that begins adjacent opening 52 of cartridge 28 and extends to the beginning of the curvature of strip 32, does not describe a spiral trajectory, but rather a series of circle arcs and straight lines. One may calculate the arc length of the spiral and the length of the last portion and then divide this total length by the "width" of one staple, thereby calculating how many staples remain in cartridge 28. In one embodiment where adhesive material is positioned between each staple, the "width" dimension of one staple will include the actual width dimension of the staple itself and the width dimension of adhesive on one side of the staple. In another embodiment where adhesive material is positioned along a backbone of the strip 32 of staples, and not between each staple, the "width" dimension of the staple will include only the actual width of an individual staple. Radius "r" may be calculated as the sum of the initial radius "Ro" plus the sum of the height "h" of a staple and the spacing "g" between adjacent loops of staples, multiplied by the angle of rotation "theta" divided by two pi "2π."

In particular, the shape described by the staple strip may be similar to an Archimedes' spiral, which is given by Equation 1:

$$r=a\Theta+b \qquad \text{Equation 1}$$

The boundary conditions for this spiral are given in Equation 2:

$$\text{at } \Theta=0\text{, then } r=Ro\text{, therefore, } b=Ro, \qquad \text{Equation 2}$$

where Ro is the base radius of spiral, i.e., the minimum radius of curvature 48, described by a series of straight lines that join all the centroids of each staple wire. According, another boundary condition is given in Equation 3:

$$\text{at } \Theta=2\pi\text{, then } r=Ro+h+g\text{, therefore, } a=(h+g)/2\pi, \qquad \text{Equation 3}$$

where g is the separation (gap) between two loops 42 and 44 of staples and h is the height of a staple wire. A differential of length of the roll 32 is given by Equation 4:

$$ds=\text{sqrt}(r^2+(dr/d\Theta)^2)d\Theta=\text{sqrt}((a\Theta+b)^2+a^2)\cdot d\Theta. \qquad \text{Equation 4}$$

Accordingly, the length of the spiral can be obtained by integrating between the original angle of rotation of the potentiometer $\Theta o$ and the final angle $\Theta f$, as shown in Equation 5:

$$s=\text{integral, from } \Theta o \text{ to } \Theta f, \text{ of } \mathrm{sqrt}((a\Theta+b)^2+a^2)d\Theta. \quad \text{Equation 5}$$

If we let $\Theta o=0$, then Equation 6 can be used to calculate the length s of the strip.

$$s=((b/2a)+(\Theta f/2))\cdot\mathrm{sqrt}(a^2+(b+a\Theta f)^2)+(1/2)a\cdot\ln(2(b+a\Theta f)+2\,\mathrm{sqrt}(a^2+(b+a\Theta f)^2)-((b/2a)\mathrm{sqrt}(a^2+b^2)+(1/2)a\cdot\ln(2b+2\,\mathrm{sqrt}(a^2+b^2)). \quad \text{Equation 6}$$

From the length s of strip 32, one may calculate the number N of staples remaining in cartridge 28 from Equation 7.

$$N=s/w, \text{ where w is the width of one staple.} \quad \text{Equation 7}$$

Figure 6A:
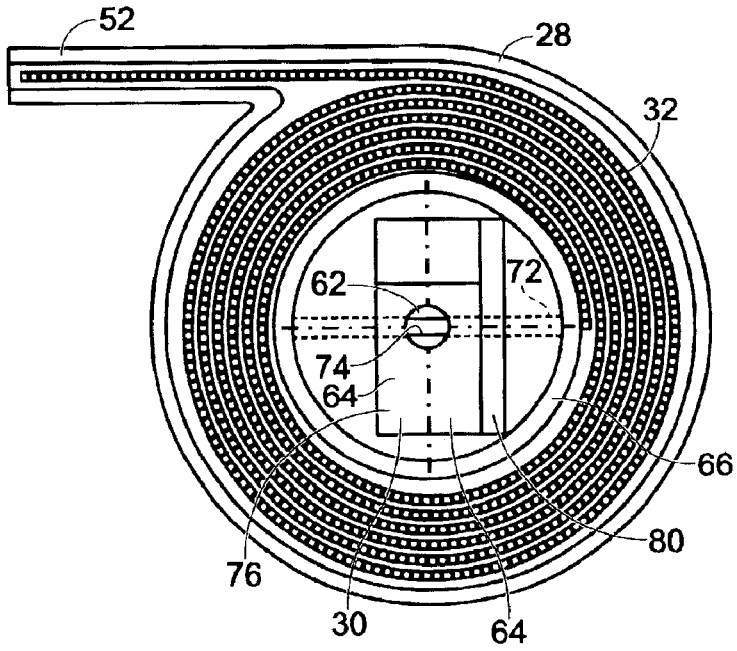
FIGS. 6A an 6B are side cross-sectional views of the staple strip of FIG. 5 and the measurement device in an initial position and having been rotated from the position in FIG. 5 through an angle theta in accordance with an example embodiment.
Figure 6B:
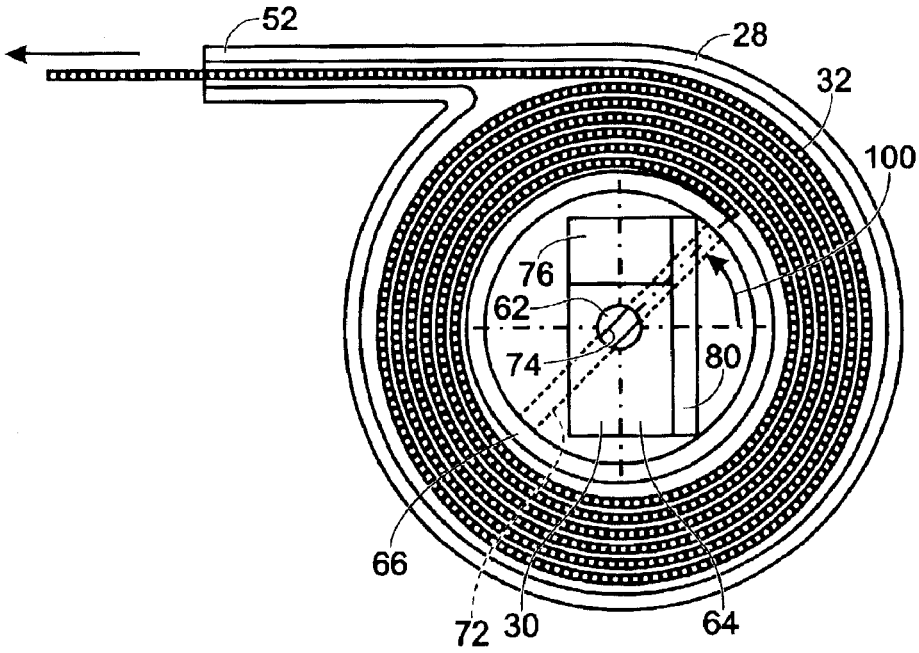

FIGS. 6A and 6B are side views of the staple strip of FIG. 5 and staple counting device 30, wherein FIG. 6A shows strip 32 in an initial position and FIG. 6B shows strip 32 having been rotated from the position in FIG. 6A through an angle 100. Accordingly, FIG. 6B shows potentiometer knob 62 having been rotated through the same angle 100 as strip 32, by cross bar 72 (see FIG. 3) of cap 68 (see FIG. 3) of staple strip core 66.

FIG. 7 is a flow diagram of one method of staple calculation of the present invention. In a first step 102 strip 32 rotates, thereby causing corresponding and simultaneous movement of core 66, cap 68, and potentiometer knob 62 through an angle 100, referred to as angle "theta." As shown in second step 104, this rotation of potentiometer knob 62 changes the resistance of potentiometer 64, wherein the resistance value is defined as the K constant "Kpot" of the potentiometer multiplied by angle "theta." In third step 106, the output voltage "V" is calculated as the resistance value "R" multiplied by the input voltage "Vc" divided by the initial resistance of the potentiometer "Rpot." In fourth step 108, an analog to digital converter (not shown) within potentiometer 64 converts the value of the output voltage "V" to a digital signal. In fifth step 110, a microprocessor on circuit board 80 (see FIG. 4) calculates angle "theta" as the output voltage "V" times the resistance of the potentiometer "Rpot" divided by the K constant "Kpot" of the potentiometer. In sixth step 112, the microprocessor of circuit board 80 (FIG. 4) calculates the length "s" of the remaining strip 32 of staples by the given equation 6, also recited above as Equation 6. In seventh step 114 the number "N" of stapes remaining in the cartridge 28 is calculated as the length "s" of the remaining strip 32 divided by the width "w" of a single staple, as shown in Equation 7 given above.

The illustrated embodiment of FIGS. 1–7 is shown to illustrate the principles and concepts of the invention as set forth in the claims below, and a variety of modifications and variations may be employed in various implementations while still falling within the scope of the claims below.

We claim:

1. A document handling machine, comprising:

a stapling device; and a staple cartridge operatively connected to said stapling device and including a staple estimating device adapted for measuring rotational movement of a roll of staples held within said staple cartridge and for estimating a quantity of the staples based on the measured rotational movement, wherein said staple estimating device comprises a potentiometer.

2. A document handling machine according to claim 1 wherein said staple estimating device further comprises a printed circuit board operatively connected to said potentiometer, said printed circuit board adapted for estimating an amount of staples held within said staple cartridge based on said measured rotational movement of said roll of staples.

3. A document handling machine according to claim 1 wherein said potentiometer includes an adjusting knob wherein rotation of said adjusting knob changes a resistance of said potentiometer, and wherein said staple cartridge further includes a core for mounting a roll of staples thereon, said core having a coupling member mounted thereon, said coupling member operatively connected to said adjusting knob such that rotation of said core causes rotation of said coupling member, thereby causing corresponding rotation of said adjusting knob.

4. A document handling machine according to claim 1 further comprising a display device operatively coupled to the staple cartridge and adapted for displaying an estimate of the amount of staples held within said staple cartridge, as estimated by said staple estimating device.

5. A document handling machine according to claim 1 further comprising an image producing device for producing an image on a print media.

6. A document handling machine according to claim 1 wherein said document handling machine is chosen from the group consisting of a printer, a facsimile machine, and a copier.

7. A device for estimating the number of staples held within a staple cartridge, wherein said staples are in the form of a roll and wherein said roll of staples rotates as individual staples of said roll are removed from said roll, the device comprising:

a potentiometer including a component that rotates simultaneous with rotation of said roll of staples, wherein rotation of said potentiometer component causes a change in resistance of said potentiometer, and a processor for estimating the number of staples based on the change in resistance of said potentiometer.

8. A device according to claim 7 wherein said component comprises an adjustment knob, said device further comprising a support structure for mounting said roll of staples thereon, wherein said support structure contacts said adjustment knob of said potentiometer such that rotation of said support structure causes corresponding rotation of said adjustment knob, and wherein rotation of said adjustment knob changes said resistance of said potentiometer.

9. A device according to claim 7 further comprising a circuit board connected to said potentiometer, wherein said circuit board receives a resistance measurement from said potentiometer and estimates the number of staples remaining in said roll of staples from said resistance measurement.

10. A device according to claim 9 wherein said circuit board includes a first wire adapted for connection to a power source, a second wire adapted for connection to a ground source and a third wire adapted for connection to a display pad for displaying the estimated number of staples remaining in said roll.

11. A method of estimating the number of staples remaining in a staple roll, comprising the steps of:

dispensing individual staples from a roll of staples by rotating the roll;

calculating the angle of rotation of the roll; and estimating a number of staples remaining in the roll based on the measured angle of rotation of the roll, wherein said step of calculating the angle of rotation of the roll comprises controlling a potentiometer input with the rotation of the roll of staples and measuring an output from the potentiometer.

12. A method according to claim 11 wherein said step of calculating the angle of rotation of the roll comprises calculating the angle from the equation: angle=vRpot/Kpot, where v is the output voltage of a potentiometer, Rpot is the resistance of the potentiometer, and Kpot is the K constant of the potentiometer.

13. A method according to claim 11 wherein said step of estimating the number of staples comprises calculating an estimated length of said roll from the equation:

$$\text{length}=((b/2a)+(f/2))\cdot\text{sqrt}(a^2+(b+af)^2)+(1/2)a\cdot\ln(2(b+af)+2\ \text{sqrt}(a^2+(b+af)^2)-((b/2a)\text{sqrt}(a^2+b^2)+(1/2)a\cdot\ln(2b+2\ \text{sqrt}\ (a^2+b^2)),$$

where f is the final angle of rotation of the roll, a is the height of a staple added to the spacing between adjacent loops of staples, divided by $2\pi$, and b is the initial inner radius of the roll.

14. A method according to claim 11 wherein said step of estimating the number of staples comprises calculating an estimated number of staples remaining from the equation: number=s/w where s is the length of the staple roll and w is the width of individual staples in said roll.

15. A printing machine comprising:

a housing that includes a display pad adapted for displaying an estimate of a number of staples remaining in a staple cartridge of said housing;

a printing device for printing an image on a sheet of print media;

a stapling device for stapling a document together, wherein said document is comprised of a plurality of said sheets of print media;

a staple cartridge for storing a strip of staples therein;

a potentiometer that measures rotational movement of said strip of staples; and a calculation device that calculates the estimate of the number of staples remaining in said strip of staples based on the rotational movement of said strip of staples measured by said potentiometer.

16. A device for estimating the number of staples held within a staple cartridge, comprising:

a staple cartridge including a core adapted for receiving a roll of staples thereon, wherein said core rotates as individual staples are removed from a roll of staples on said core; and a potentiometer operatively connected to said core such that rotation of said core causes a change in resistance of said potentiometer, and a processor configured to estimate a number of staples remaining in said roll based on the resistance of said potentiometer.

17. A device according to claim 16 wherein said processor approximates a shape of a roll of staples on said core as an Archimedes' spiral.

18. A device according to claim 16 further comprising a cap mounted on said core, said cap including a crossbar received within a slot of an adjustment knob of said potentiometer, wherein rotation of said core causes corresponding rotation of said cap, and wherein rotation of said cap causes corresponding rotation of said potentiometer adjustment knob thereby changing a resistance value of said potentiometer.

19. A document handling machine, comprising:

storing means for storing staples; and estimation means for estimating a number staples stored within said storing means, said estimating means adapted for measuring rotational movement of a roll of staples held within said storing means so as to estimate an amount of staples held within said storing means, wherein said estimation means comprises a potentiometer.

* * * * *

UNITED STATES PATENT AND TRADEMARK OFFICE

CERTIFICATE OF CORRECTION

PATENT NO. : 6,918,580 B2
APPLICATION NO. : 10/420234
DATED : July 19, 2005
INVENTOR(S) : Roberto Obregon et al.

It is certified that error appears in the above-identified patent and that said Letters Patent is hereby corrected as shown below:

IN THE CLAIMS

Claim 19, Column 8, line 28, after "a number" insert --of--

Signed and Sealed this

Twenty-seventh Day of May, 2008

JON W. DUDAS
*Director of the United States Patent and Trademark Office*